US008448280B2

(12) United States Patent
Aumuller et al.

(10) Patent No.: US 8,448,280 B2
(45) Date of Patent: May 28, 2013

(54) METHOD OF PROVIDING A PARAPET WALL ON A BRIDGE

(75) Inventors: Paul M. Aumuller, Guelph (CA); Ed Newton, Guelph (CA); Thomas Koester, Guelph (CA)

(73) Assignee: Newton Bridge Solutions Ltd, Guelph (CA)

( * ) Notice: Subject to any disclaimer, the term of this patent is extended or adjusted under 35 U.S.C. 154(b) by 0 days.

(21) Appl. No.: 13/530,531

(22) Filed: Jun. 22, 2012

(65) Prior Publication Data

US 2012/0260439 A1 Oct. 18, 2012

Related U.S. Application Data

(62) Division of application No. 12/827,462, filed on Jun. 30, 2010, now Pat. No. 8,234,738.

(60) Provisional application No. 61/313,932, filed on Mar. 15, 2010, provisional application No. 61/329,591, filed on Apr. 30, 2010, provisional application No. 61/351,589, filed on Jun. 4, 2010.

(30) Foreign Application Priority Data

Apr. 30, 2010 (CA) ..... 2702546
Jun. 3, 2010 (CA) ..... 2708769

(51) Int. Cl.
*E01D 21/00* (2006.01)

(52) U.S. Cl.
CPC ..... *E01D 21/00* (2013.01)
USPC ..... 14/77.1

(58) Field of Classification Search
CPC ..... E01D 21/00
USPC ..... 14/73, 77.1; 404/6
See application file for complete search history.

(56) References Cited

U.S. PATENT DOCUMENTS 3,678,815 A * 7/1972 Younker ..... 14/73
4,300,320 A * 11/1981 Rooney ..... 14/73

(Continued)

FOREIGN PATENT DOCUMENTS

JP 01210510 A 8/1989

OTHER PUBLICATIONS

"GOBACAR—Das System" web page. (Believed to have been offered for sale, publicly used, and/or published as early as Nov. 10, 2011.).

*Primary Examiner* — Raymond W Addie
(74) *Attorney, Agent, or Firm* — Gifford, Krass, Sprinkle, Anderson & Citkowski, P.C.

(57) ABSTRACT

A bridge replacement method is disclosed. The bridge includes a deck supported by a pair of abutments, each abutment having wing walls. The deck is removed, footings are cast in holes dug behind each abutment and a pier is provided on each footing. Substantially parallel and coplanar cambered beams are provided. Each beam spans between and is supported by the piers. A brace assembly reinforces the beam camber. On each adjacent pair of beams, precast deck elements are placed, such that each element of said plurality spans the beam pair, to define at least transverse gaps between the elements and put the upper surfaces of the elements in compression in a transverse direction. The gaps are grouted. After grout curing, the brace is adjusted to reduce the beam camber and cause the upper surface of the elements to also be put into compression in a direction parallel to the beams.

5 Claims, 15 Drawing Sheets

U.S. PATENT DOCUMENTS

| | | | | |
|---|---|---|---|---|
| 4,493,177 | A | 1/1985 | Grossman | |
| 4,604,841 | A * | 8/1986 | Barnoff et al. | 52/174 |
| 4,709,456 | A | 12/1987 | Iyer | |
| 4,710,994 | A | 12/1987 | Kishida et al. | |
| 4,972,537 | A | 11/1990 | Slaw, Sr. | |
| 5,301,483 | A | 4/1994 | Grossman | |
| 5,471,694 | A | 12/1995 | Meheen | |
| 5,617,599 | A | 4/1997 | Smith | |
| 5,651,635 | A * | 7/1997 | Nagle | 404/6 |
| 5,655,243 | A | 8/1997 | Kim | |
| 5,850,653 | A | 12/1998 | Mufti | |
| 6,065,257 | A | 5/2000 | Nacey et al. | |
| 6,588,160 | B1 | 7/2003 | Grossman | |
| 6,898,910 | B2 * | 5/2005 | Bellino, Jr. | 52/393 |
| 7,296,317 | B2 | 11/2007 | Grace | |
| 2004/0216249 | A1 | 11/2004 | El-Badry | |
| 2011/0138549 | A1 | 6/2011 | He | |

* cited by examiner

METHOD OF PROVIDING A PARAPET WALL ON A BRIDGE

REFERENCE TO RELATED APPLICATIONS

This application is a divisional of U.S. patent application Ser. 12/827,462 filed June 30, 2010, which claims priority of U.S. Provisional Application 61/313,932 filed Mar. 15, 2010; U.S. Provisional Application 61/329,591 filed Apr. 30, 2010; Canadian Patent Application 2,702,546 filed Apr. 30, 2010; Canadian Patent Application 2,708,769 filed Jun. 30, 2010; and U.S. Provisional Application 61,351,589 filed Jun. 4, 2010. The contents of each of these applications are incorporated herein by reference.

FIELD OF THE INVENTION

The present invention relates to the field of bridge construction.

BACKGROUND OF THE INVENTION

Bridges need replacement from time to time. This is often very expensive. Environmental concerns can complicate many bridge projects; a factor in this is that many bridges span watercourses and many jurisdictions discourage the placement of support works in and near watercourses.

SUMMARY OF THE INVENTION

A method for replacing a bridge forms one aspect of the invention. The bridge which may be replaced by the method is the type which includes a deck supported at its ends by a pair of spaced-apart concrete abutments, each abutment having a pair of wing walls. The method comprises the steps of: removing the deck and excavating a footing hole behind each abutment; casting a concrete footing in each footing hole; and providing a foundation pier on each footing. The method further comprises the step of providing a brace assembly and at least a pair of cambered beams. The beams are provided such that each beam spans between and is supported by the pair of piers and the beams are substantially parallel and coplanar. The brace assembly is provided to reinforce the camber of said beams. The method further comprises the step of placing, on each adjacent pair of beams, a plurality of precast deck elements, such that each deck element of said plurality spans the pair of beams, thereby to define at least transverse gaps between the deck elements and put the upper surfaces of the deck elements in compression in a transverse direction. The method further comprises the steps of grouting the gaps; and after the grout has cured, adjusting the brace assembly to reduce the camber of the beams and cause the upper surface of the deck elements to also be put into compression in a direction parallel to the beams, to form a crack-resistant cementitious deck.

According to another aspect of the invention, the abutments and wingwalls can be cut down in height prior to the providing step.

According to another aspect of the invention, in the providing step, the beams can be temporarily supported by jacks on the abutments; and while supported by the jacks, the beams can be secured to the piers.

According to another aspect of the invention, at each end of each beam there can be provided a bearing; and the piers can have provided therein sockets for receiving the bearings, such that, when the beams are temporarily supported by the jacks, each bearing is disposed in a respective socket.

According to another aspect of the invention, the beams can be secured to the piers by cementing the bearings into the sockets.

According to another aspect of the invention the brace assembly can comprise a brace subassembly for each beam, the brace subassembly being secured to said each beam prior to the providing step.

According to another aspect of the invention, at least three beams can be positioned to span the piers to define a pair of outer beams and at least one inner beam, and such that the deck elements define a longitudinal gap along each inner beam.

According to another aspect of the invention at least one of the deck elements can be a standard deck element, the standard deck element having four sides, two opposite sides of said four sides having a plurality of recesses therein and the other two sides having defined therein grooves.

According to another aspect of the invention the standard deck element can be planar and have a hook bar for each recess, the hook bar being in the form of a u-shaped rebar element, the open ends of the hook bar being cast in the standard deck element, the rebar lying substantially coplanar with the standard deck element and the looped end of said hook bar protruding into said each recess.

According to another aspect of the invention each beam can have on its upper convex surface a plurality of Nelson studs.

According to other aspects of the invention: each outermost beam can have the studs disposed in a single row and each inner beam can have the studs disposed in a pair of rows; in the course of assembly, the looped-ends can be placed over the Nelson studs, thereby to provide a mechanical connection between the deck elements and beams; and closed hooks can be laid upon adjacent hook bars to mechanically connect laterally-adjacent Nelson studs.

According to another aspect of the invention, the pier can be a pre-cast concrete pier.

According to another aspect of the invention, the method can further comprise the step of: securing a pair of parapet walls to the deck.

According to another aspect of the invention, the deck can have a plurality of reinforcing members extending vertically therefrom; the parapet walls can be defined in part by precast cementitious elements, the precast elements having defined therein, for each reinforcing member, a bore, the bore having an irregular girth; and the parapet walls can be secured to the deck by: positioning the cementitious elements on the deck with each bore in receipt of the reinforcing member for which it is provided; and cementing the bores.

A bridge forms yet another aspect of the invention. The bridge comprises: a pair of spaced-apart concrete abutments; a cast in situ concrete footing behind each abutment; a precast concrete foundation pier on each footing; at least a pair of substantially parallel and coplanar cambered beams, each beam spanning between and supported by the pair of piers; and on each adjacent pair of beams, a plurality of precast deck elements, each deck element spanning the pair of beams, the deck elements being grouted together, the upper surfaces of the deck elements being in compression in a direction transverse to the beams and in a direction parallel to the beams, to form a crack-resistant cementitious deck.

Advantages of the invention will become apparent to persons of ordinary skill in the art upon review of the appended claims and upon review of the following detailed description of an exemplary embodiment of the invention and the accompanying drawings, the latter being described briefly hereinafter.

DETAILED DESCRIPTION

The Bridge

Figure 1:
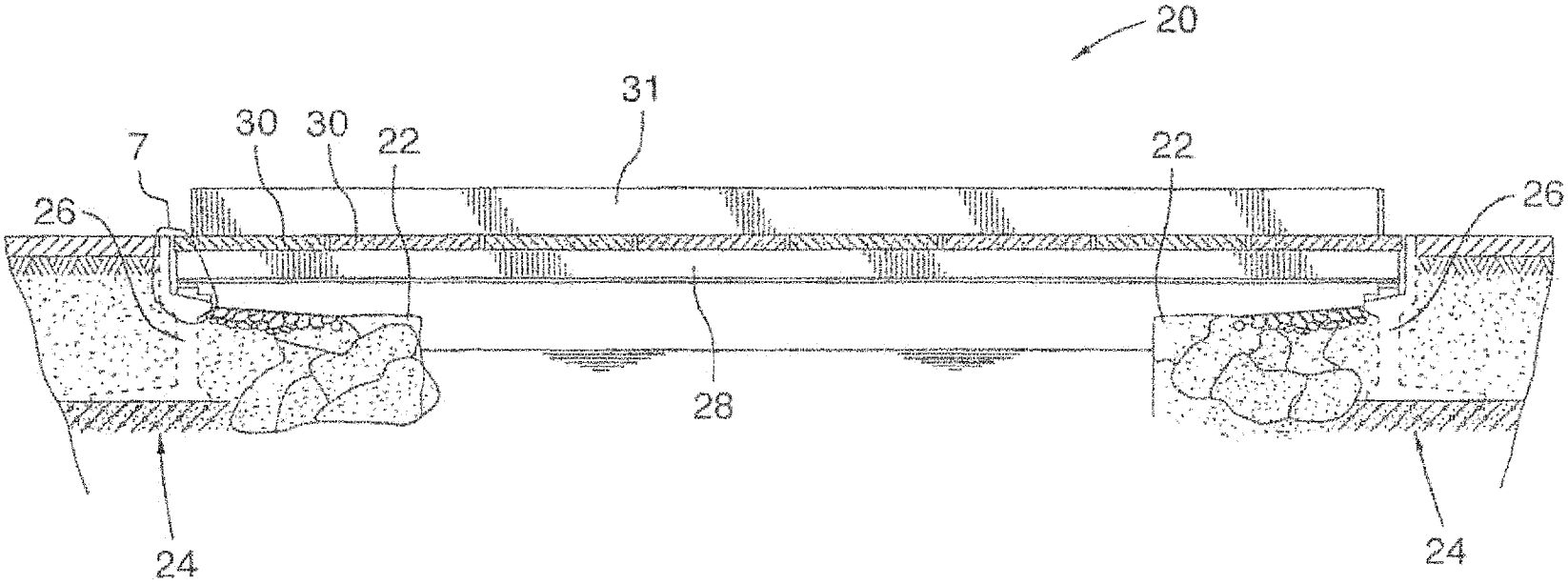
FIG. 1 is a side view of a bridge according to an exemplary embodiment of the invention.
Figure 2:
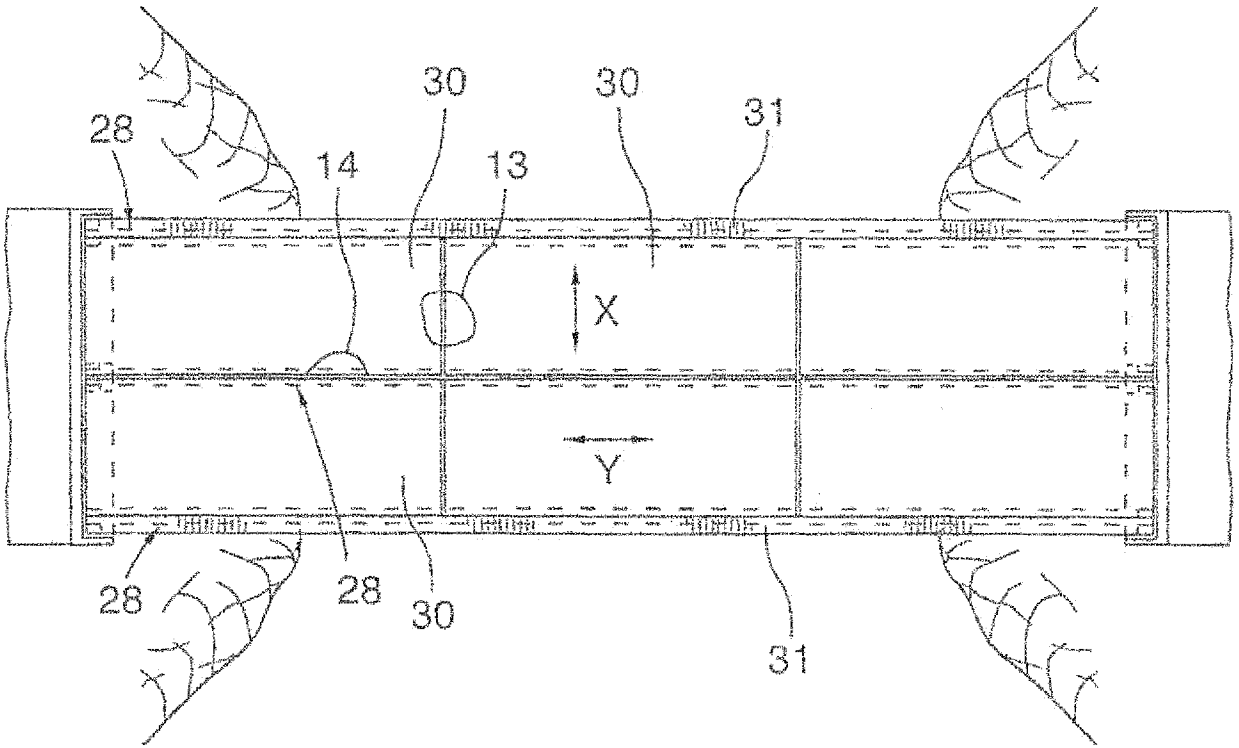
FIG. 2 is a top plan view of the structure of FIG. 1.

A bridge 20 according to an exemplary embodiment of the invention is illustrated in FIG. 1 and FIG. 2 and will be seen to comprise: a pair of abutments 22, a pair of footings 24, a pair of foundation piers 26, three cambered beams 28; deck elements 30; and parapet walls 31.

The abutments 22 are concrete, and spaced-apart across a watercourse.

The footings 24 are concrete, cast in situ, behind each abutment 22. Footing construction is a matter of routine to persons of ordinary skill in the art, and as such, details are neither required nor provided herein.

The piers 26 are pre-cast concrete, positioned one on each footing 24. Pier construction is a matter of routine to persons of ordinary skill in the art, and as such, details are neither required nor provided herein.

The beams 28 are substantially parallel and coplanar. Each beam 28 spans between the pair of piers 26. Parapet walls 31 are defined by pre-cast cementitious elements and also span between the pair of piers 26. The beams 28 are steel I-beams. The beams 28 and parapet walls 31 are adapted to carry their own loads, the loads of the deck elements 30 and any loads to be carried by the bridge 20. Load calculation is a matter of routine to persons of ordinary skill in the art, and as such, details are neither required nor provided herein. The parapet walls 31 shown extend to piers 26 and as such, piers 26 bear the loads of the beams 28, deck elements 30, parapet walls 31 and any loads carried by the bridge. The beams 28 are secured to the piers 26 by conventional bearings, indicated by 37 on FIGS. 7, 8. Bearing design is a matter of routine to persons of ordinary skill in the art and as such, details are neither required nor provided.

The deck elements 30 are precast concrete. As indicated in FIG. 2, a plurality of the deck elements 30 are positioned on each adjacent pair of beams 28, with each deck element 30 spanning the pair of beams 28 such that the upper surface of said each deck element 30 is in compression in a direction X transverse to the beams 28. As well, the deck elements 30 are grouted together and arranged in a manner such that the upper surfaces of the deck elements are in compression Y in a direction parallel to the beams. The deck elements 30 bear their own loads, as well as any loads to be carried by the bridge 20.

Standard Deck Element

Figure 3:
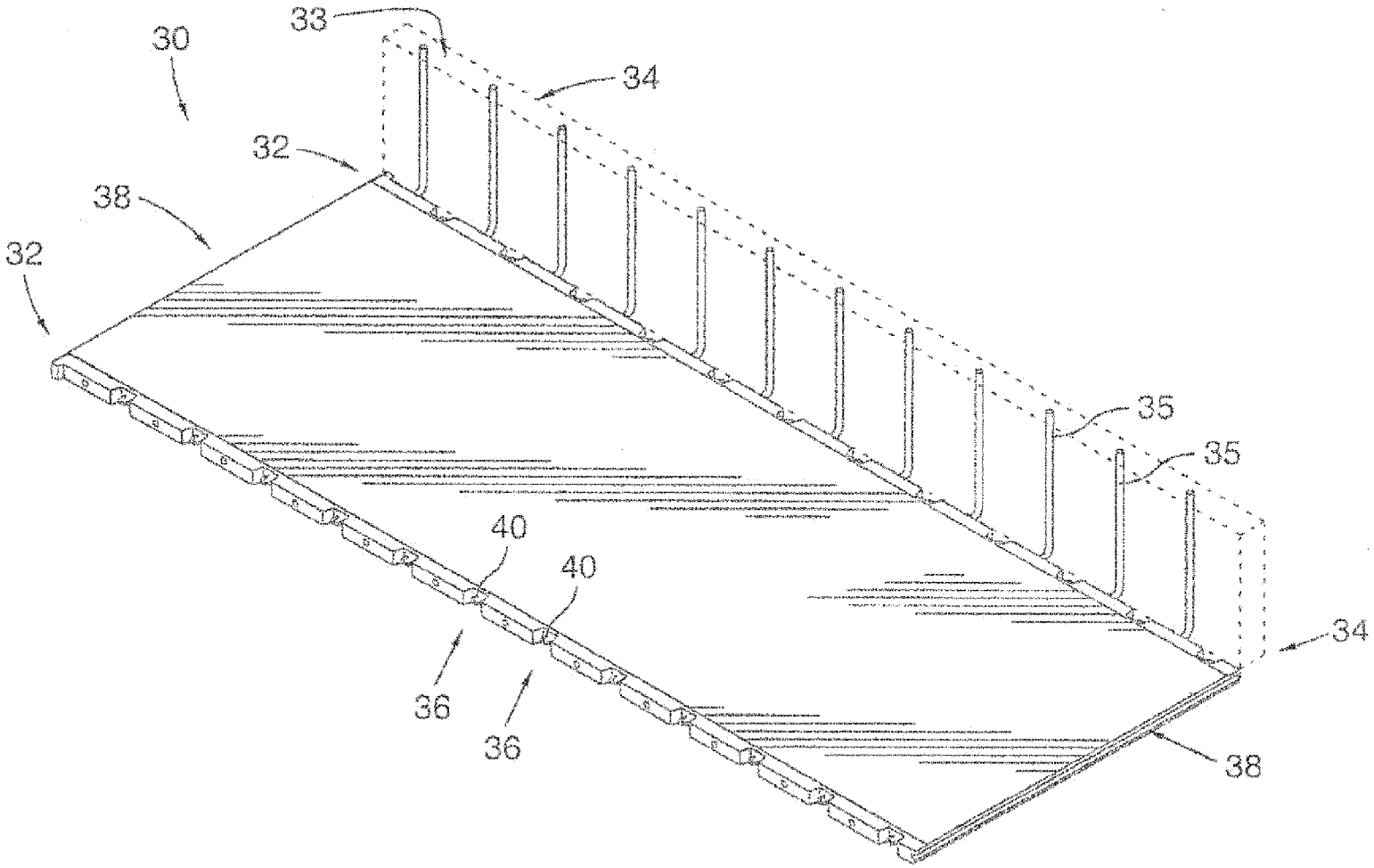
FIG. 3 is a perspective view of a portion of FIG. 1 structure, with portions in phantom.

An exemplary embodiment of a standard deck element 30 is shown in solid line in FIG. 3 and will be seen to be planar and have four sides 32,32,34,34. Two opposite sides 32 of said four sides have a plurality of recesses 36 therein and the other two sides 34 have defined therein grooves 38. A hook bar 40, in the form of a u-shaped rebar element, is provided for each recess 36. The open ends of the hook bar 40 are cast in the standard deck element 30 such that the rebar lies substantially coplanar with the standard deck element 30 and the looped end of said hook bar 40 protrudes into said each recess 36. The diameter of the rebar forming the hook bar is 10 mm. From one edge of the deck element, a plurality of rebar elements 35 extend vertically.

Figure 4:
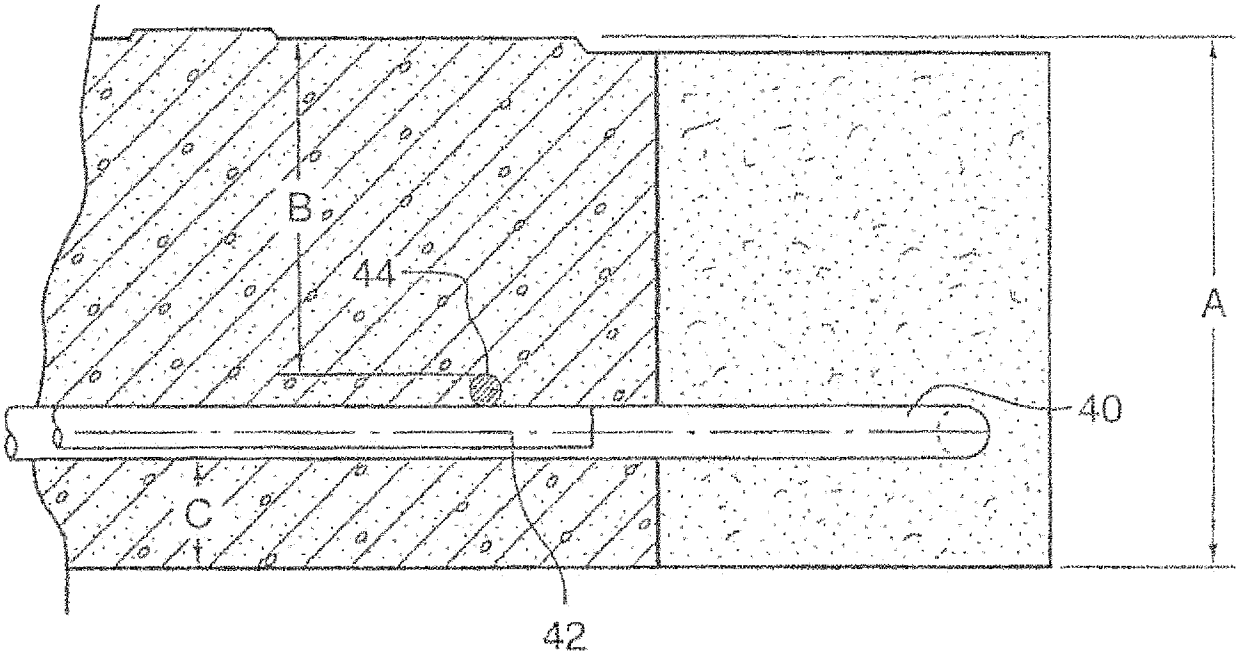
FIG. 4 is a cross-sectional view of a portion of the structure of FIG. 3.

FIG. 4 is a partial cross-sectional view of the deck element of FIG. 3. From this, it will be understood that a reinforcement lattice is positioned within the body of the deck element 30 and dimensioned similarly to but slightly smaller than the element such that, when positioned, there is clearance between the rebar lattice and the outer edges of the concrete. The rebar lattice takes the form of about 8 mm diameter high tensile cold-drawn wire 42 extending transversely of the deck element 30 and about 6 mm diameter high tensile cold-drawn wire 44 extending longitudinally of the deck element 30 and rigidly interconnecting the about 8 mm wire 42. The thickness of the panel A is 105 mm. The depth B of the u-shaped rebar elements 40 and the rebar mat 42,44 from the upper surface of the deck element 30, i.e. the amount of concrete coverage, is 55 mm. The amount of lower concrete coverage C, i.e. the thickness of the concrete beneath the U-shaped rebar element 40 is 34 mm.

The concrete employed in the exemplary embodiment has the following physical properties:

| | |
|---|---|
| compressive strength >45 MPa in 28 days | CSA 23.2-9C/ASTM C1074 |
| water absorption <4% | CSA A23.2-11C |
| salt scaling freeze/thaw <800 mg/m$^2$ | MTO LS-412/ASTM C672 |
| linear shrinkage <0.04% | MTO LS-435 |
| chloride permeability <1000 Coulombs | ASTM C1202] |
| chloride diffusion coefficient <1.8 × 10$^{-12}$ m$^2$/s | |
| lifecycle >40 years according to LIFE365 model | |

Concrete having these performance characteristics can be readily produced by persons of ordinary skill in the art, and thus, is not described herein in detail.

Construction of the Bridge

Figure 5:
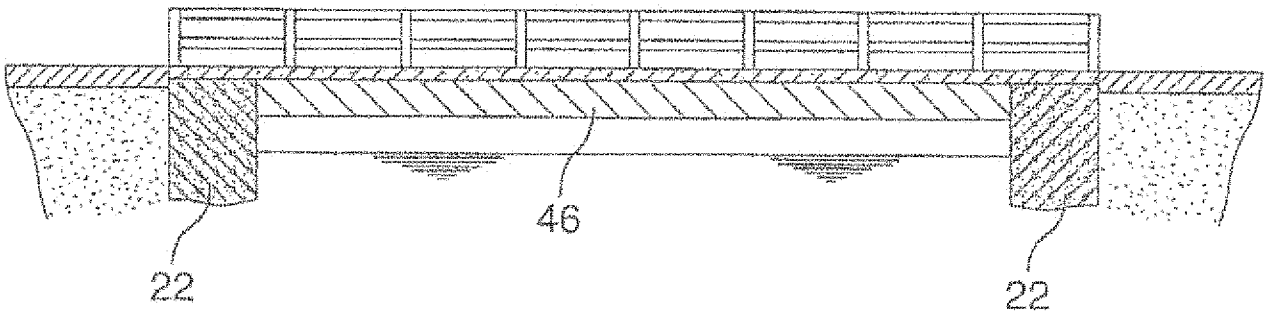
FIG.5 PRIOR ART
FIG. 5 is a view similar to FIG. 1 of a prior art bridge.

Construction of the bridge shown in FIG. 1 commences with a bridge as shown in FIG. 5, i.e. a conventional bridge of the type including a cast-in-place reinforced concrete deck 46 supported at its ends by a pair of spaced-apart concrete abutments 22. The conventional bridge will normally be in a sufficiently poor state of repair as to justify replacement.

Initial steps in the replacement process involve:

removing the deck and parapet walls of the existing bridge;

cutting down the abutments and any associated wing walls, excavating a footing hole behind each abutment;

casting the aforementioned footings in the footing holes; and installing the aforementioned concrete piers on the footings.

Figure 6:
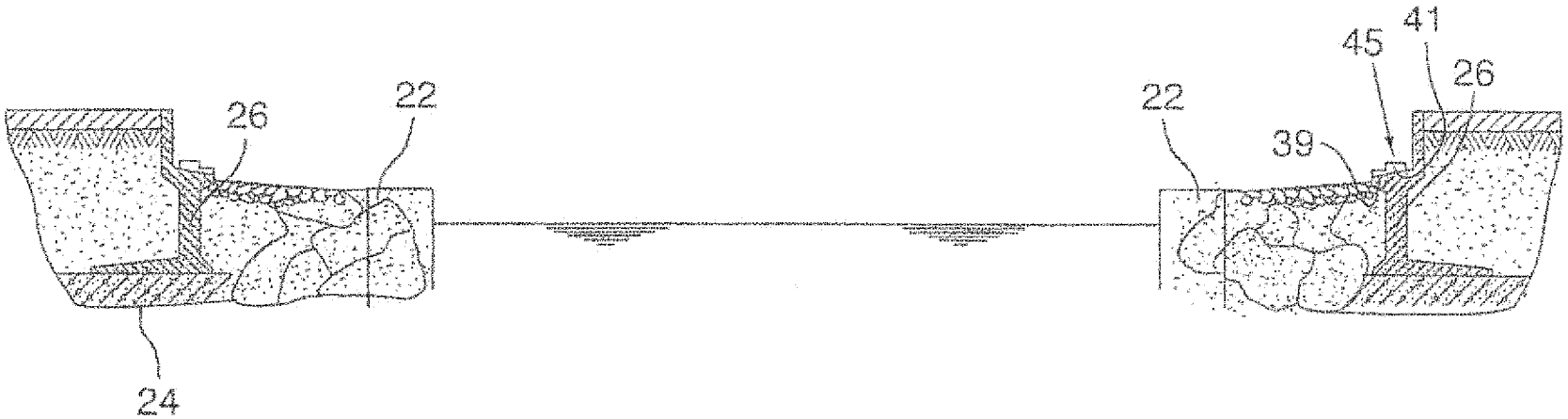
FIG. 6 is a view of the structure of FIG. 1, with portions not yet in place.

Demolition of decks, digging holes, casting footings and installing concrete piers are skills within the knowledge of persons of ordinary skill in the art, and as such, detailed description is neither required nor provided. FIG. 6 shows backfilled concrete footings 24, and on each footing 24, a foundation pier 26 installed. The pier 26 will be seen to have a sloped upper surface 39, and, for each beam, a rectangular protuberance 41 extending from the upper surface 39. In each protuberance 41 therein is defined a socket 45.

The remainder of the exemplary method involves the following steps set forth below in point form, and described fully in subsequent paragraphs.

i. a brace subassembly is secured to each beam;

ii. jacks are positioned on the abutments and the beams are positioned and levelled with the jacks, with portions of the bearings associated with the beams disposed in the sockets in the piers;

iii. the bearings are cemented in the sockets;

iv. the deck elements are placed on the beams and grouted together;

v. the brace subassemblies and jacks are removed, to create a combined profile;

vi. precast elements are fitted on the vertical reinforcing bars; and vii. the bores in the precast elements are cemented.

Some flexibility in terms of the order of steps (i)-(vii) is permissible, but it is contemplated that the brace subassemblies will normally installed prior to the placement of the beams on the jacks, and removed after the deck grout has cured.

The purpose of the plurality of brace subassemblies, which collectively define a brace assembly, is to ensure that, after the deck elements are placed on the beams, the beams do not substantially sag; the brace assembly is sized accordingly. The manner of construction of such a brace assembly is a matter of routine to persons of ordinary skill in the art, and as such, detail is neither required nor provided. However, reference is made to FIG. 9, wherein an exemplary brace assembly can be seen to take the form of a length of cable 71, connected to anchor lugs 73 welded to the beam, and tensioned by a central jack 75.

Figure 9:
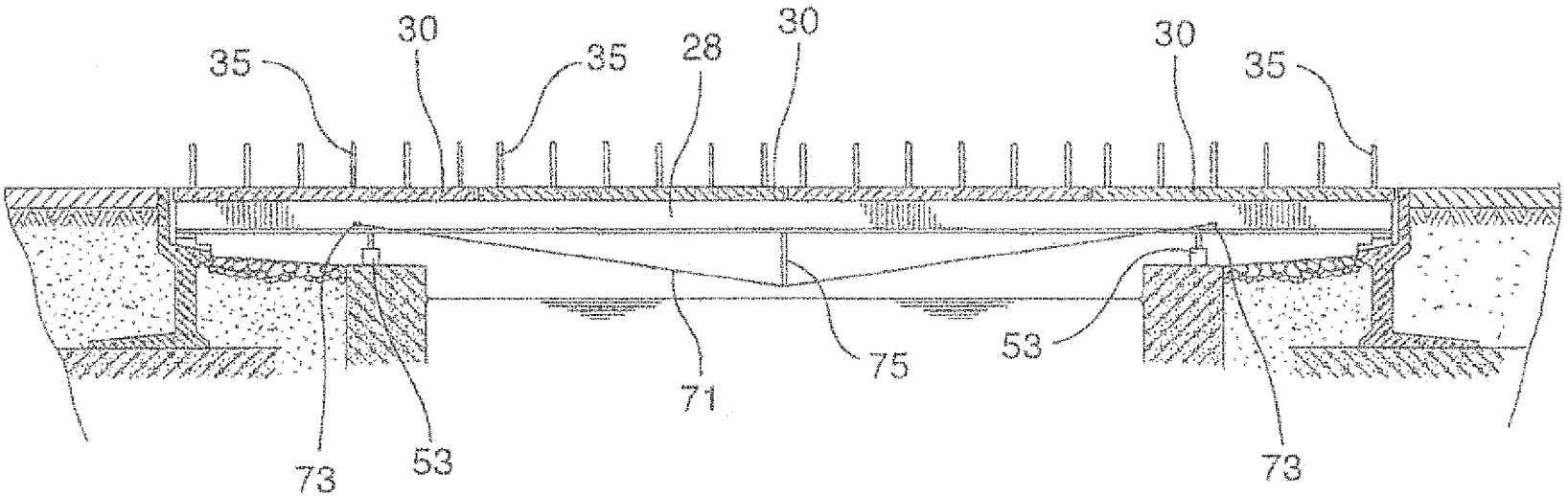
FIG. 9 is a view of the FIG. 1 structure, partially-completed, with temporary bracing.

With respect to (ii), the beams are positioned on the piers such that each beam spans between the pair of piers and the beams are substantially parallel and coplanar. Normally, at least three beams are positioned to span the piers to define a pair of outer beams and at least one inner beam. The camber in the beams is such that each beam, when installed, is slightly higher at its midpoint than at its ends. Each beam has, on its upper convex surface, a plurality of Nelson studs: each outermost beam has the studs disposed in at least a single row and each inner beam has the studs disposed in a pair of rows. At the end of each beam, a conventional bearing is secured, with a depending anchor which projects into a socket of the pier. Temporary jacks 53 which temporarily support the beams 28 and permit beams 28 to be maintain level until the bearing is fully connected are indicated in FIG. 9. Shims 90 are used temporarily to maintain stability during the grouting phase of the bearings.

Figure 8:
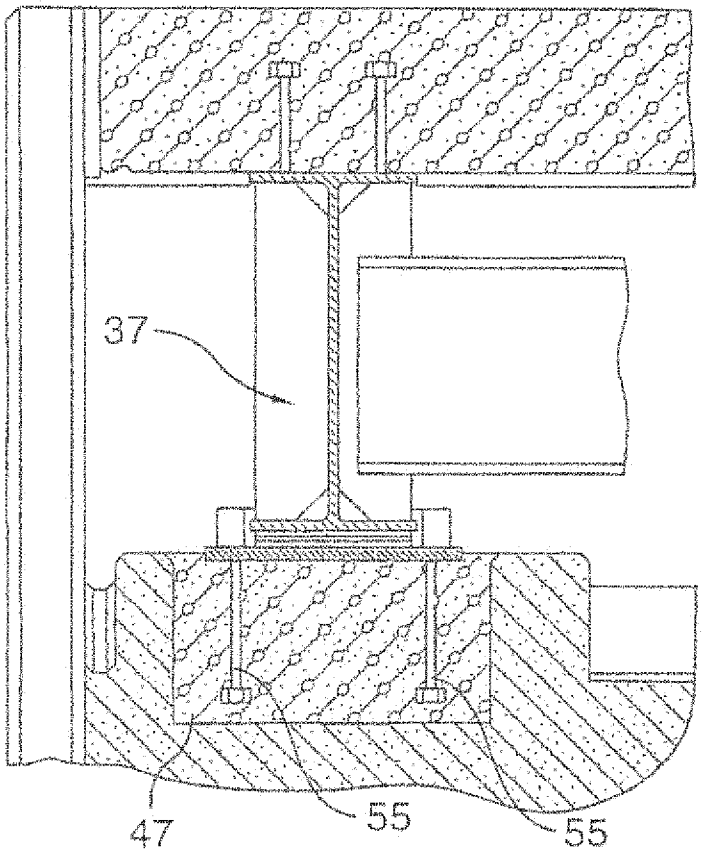
FIG. 8 is a side view of the structure of FIG. 7.
Figure 7:
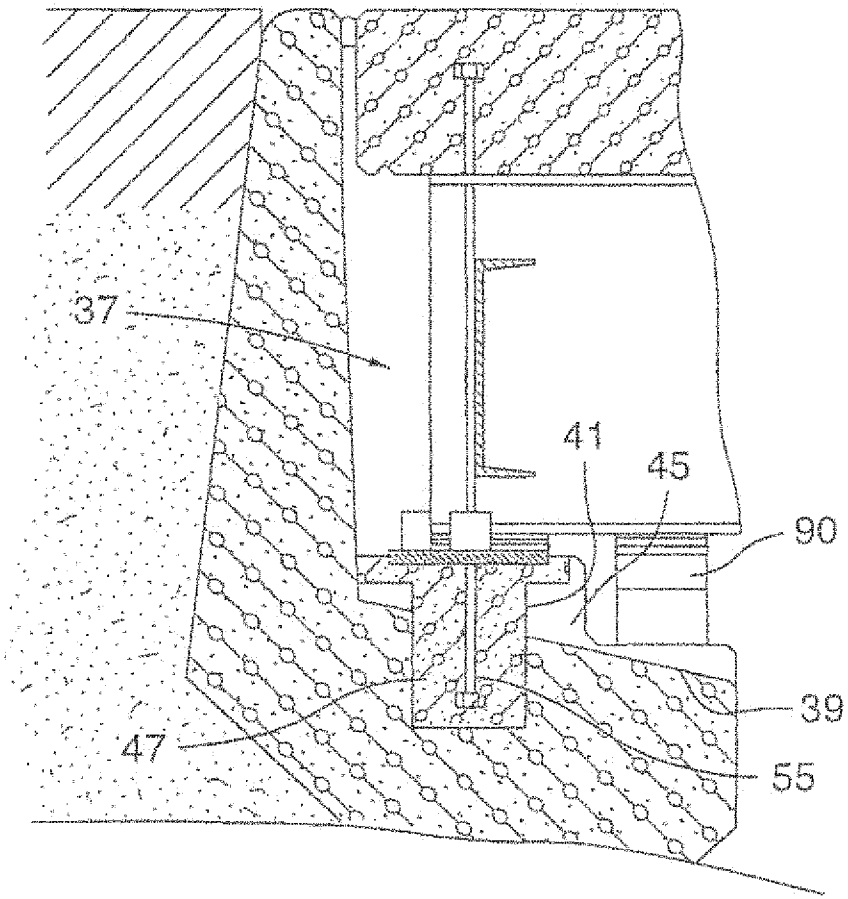
FIG. 7 is an enlarged view of encircled structure 7 of FIG. 1.

With respect to (iii), the cement holding the bearing is shown in FIG. 7 and FIG. 8 by reference numeral 47. Persons of ordinary skill in the art will appreciate that, although the bearings are conventional, the manner of connection of the bearings to the beams and piers in the method is unique in that, herein, the bearings are connected to the beams ab initio and connected to the piers by cementing depending anchors 55 associated with the bearings 37 into the sockets 41, whereas a conventional approach for beam connection would involve an initial connection of the bearings to the piers, and a subsequent connection of the bearings to the beams.

Figure 10:
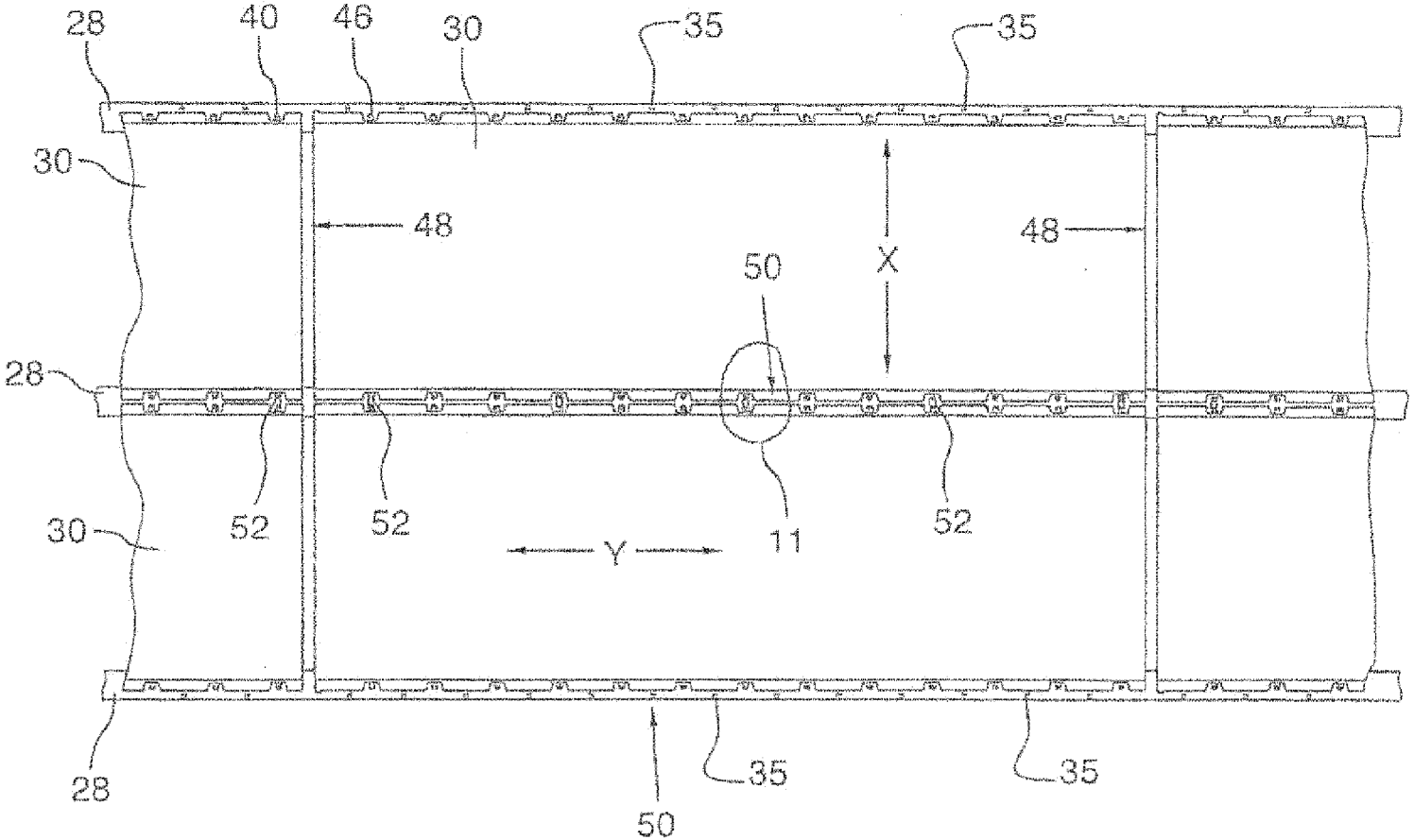
FIG. 10 is a top plan view of the structure of FIG. 9.

With respect to (iv) on each adjacent pair of beams 28, a plurality of precast deck elements 30 are placed, as indicated in FIG. 9 and FIG. 10, thereby to define transverse gaps 48 between the deck elements 30 of the plurality and to put the upper surfaces of the deck elements 30 in compression in direction X transverse to the beams 28.

Figure 11:
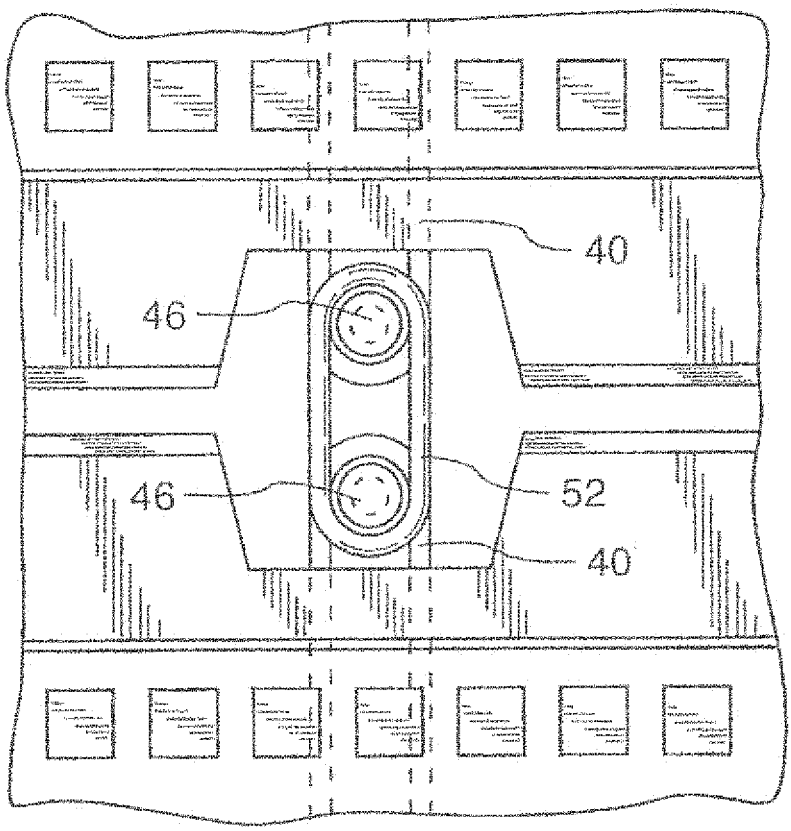
FIG. 11 is an enlarged view of encircled structure 11 of FIG. 10.
Figure 12:
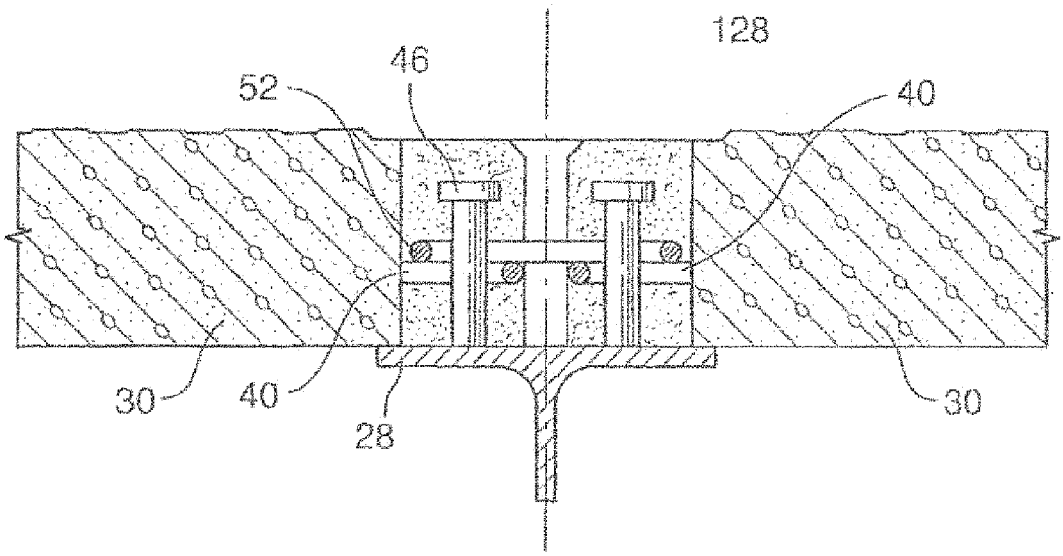
FIG. 12 is a cross-sectional view of the structure of FIG. 11.
Figure 13:
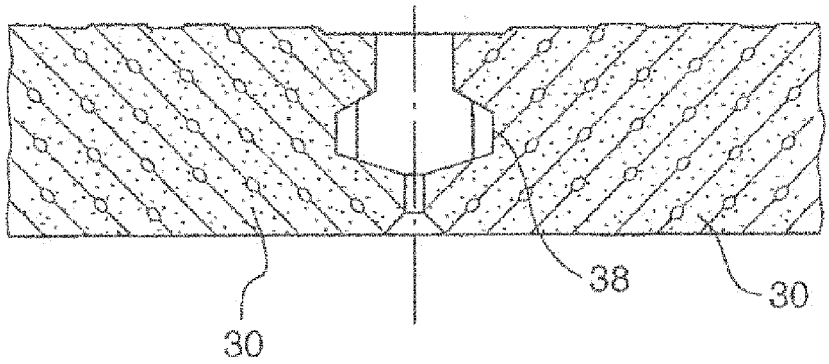
FIG. 13 is a cross-sectional view of the structure of encircled area 13 of FIG. 2.

On the outermost beams of the bridge, longitudinal gaps 50 are present. Also, in the context of bridges having more than two beams, i.e. as in the usual case and as shown in FIG. 10, the deck elements 30 define a longitudinal gap 50 along each inner beam. In the course of assembly, the looped-ends 40 are placed over the Nelson studs 46, to provide a mechanical connection between the deck elements 30 and beams 28, and closed hooks 52 are laid upon selected adjacent hook bars 40 to mechanically connect laterally-adjacent Nelson studs 46, as best indicated in FIG. 11 and FIG. 12.

With steps (i)-(iv) complete, the gaps 48, 50 between the deck elements, i.e. along each beam, will be filled with grout 60, and the grout 60 will be allowed to cure. Thereafter, the brace assembly will be adjusted i.e. released, to generate a composite profile by reducing the camber of the beams 28, thereby to cause the upper surface of the deck elements 30 to also be put into compression in the direction Y parallel to the beams. These aforementioned biaxial compressive stresses tend to avoid crack propagation in the concrete upper surface. Once the stresses have been removed from the brace assembly, it will be removed. Temporary forms and foam inserts are used to hold the grout in place while it cures.

Figure 17:
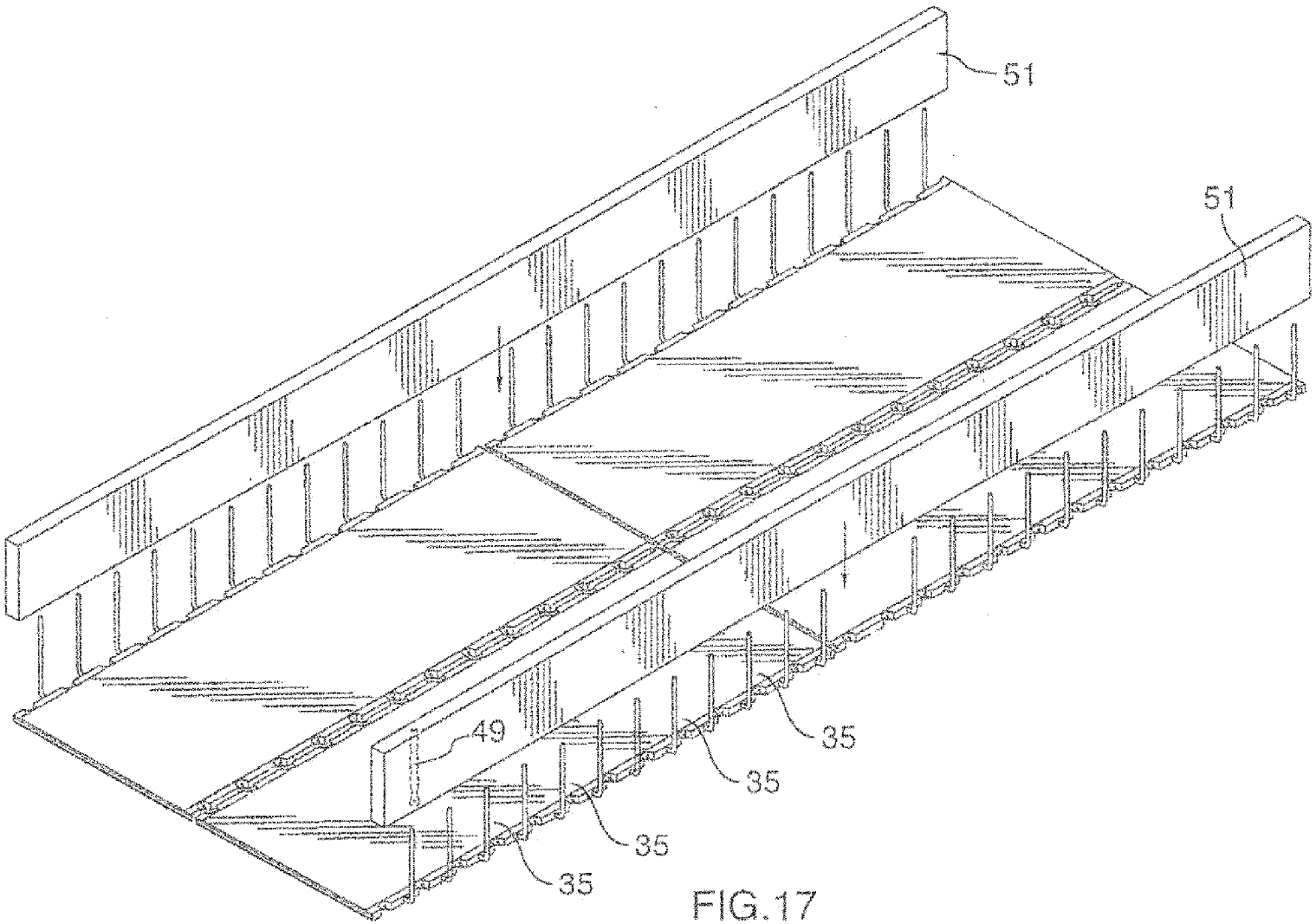
FIG. 17 is a view of the structure of FIG. 1 during assembly.

With respect to (vi), FIG. 17 is a view showing the pre-cast cementitious elements 51 which define the parapet walls 31 being lowered, such that each vertical rebar element 35 of the deck extends into a respective irregular-shaped bore 49 defined in the pre-cast element (for clarity, only one bore 49 is shown in FIG. 17). As shown in FIG. 17, both the reinforcement bars 35 and the bores 49 in the pre-cast member 51 are equally spaced. The bores 49 extend from the bottom to the top of the pre-cast members 51 and have cross-sections of varying width along their height.

With respect to (vii), once the pre-cast elements 51 have been lowered into place, a fluid cementious mixture is used to fill the bores 49. The irregular shape of the bores 49 ensure that the solidified mixture forms a solid plug, that resists extraction. This mechanically ties the pre-cast element 51 to the deck, such that parapet walls 31 define beams that substantially reinforcing the bridge deck against sagging.

Figure 14:
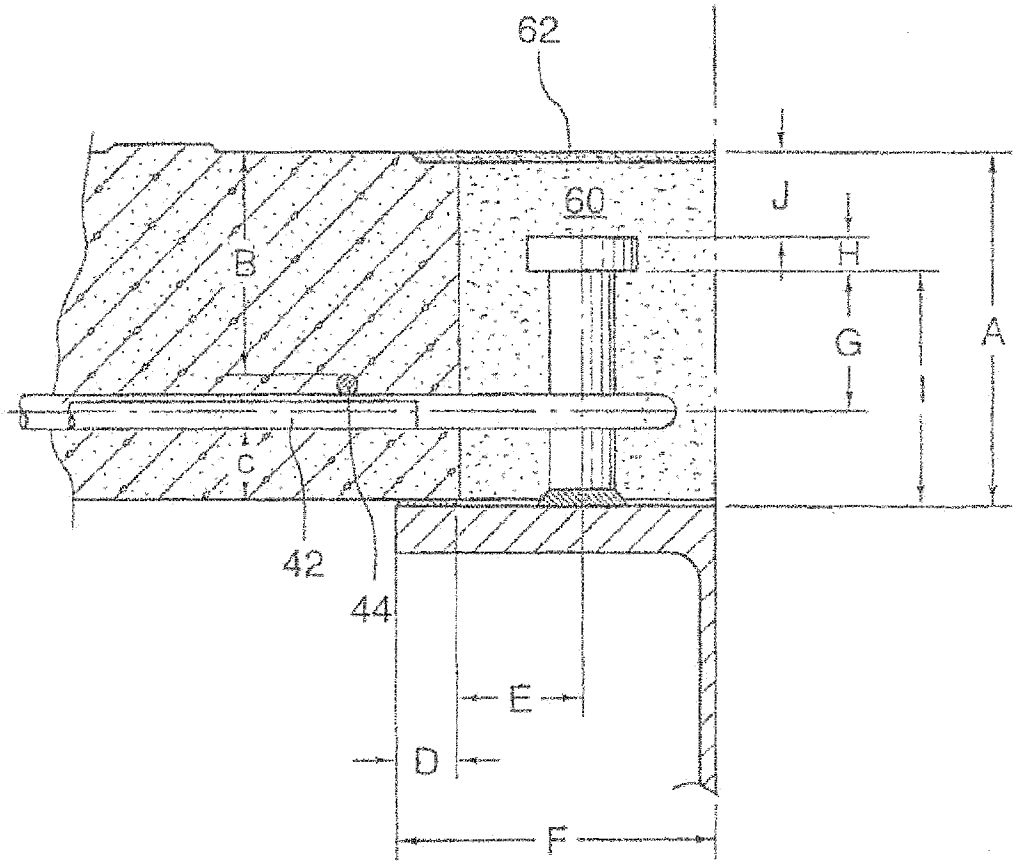
FIG. 14 is a cross-sectional view of the structure of encircled area 14 of FIG. 2.

With the parapet walls 31 in place, an impermeable waterproofing topping will advantageously be applied at least over the grout, as the upper surface of the grout over the longitudinal gaps is under tension and otherwise susceptible to cracks and associated water and salt infiltration, which would otherwise promote corrosion and generally reduce the expected lifespan of the structure. FIG. 14 is a view similar to FIG. 4, but of the finished structure, i.e. with the grout 60 and topping 62.

Various dimensions in respect of this structure are as specified below, in mm:

| | | |
|---|---|---|
| A | thickness of panel | 105 |
| B | upper concrete cover | 55 |
| C | lower concrete cover | 34 |
| D | minimum overlap of deck element on beam | 19 |
| E | distance of Nelson stud [centreline] from deck element | 36 |
| F | half-width of beam | 95 |
| G | distance from centreline of hook bar to underside of stud cap | 29 |
| H | height of stud cap | 10 |
| I | height to stud cap | 70 |
| J | minimum coverage over Nelson stud | 24 |

Variants

Whereas but a single exemplary embodiment of the method is described herein, it will be evident that variations are possible without departing from the invention.

For example, whereas in the exemplary embodiment, it is indicated the brace subassemblies is positioned along with the beams, this is not necessary; the beams could readily be secured initially to the piers and then tensioned by the brace assembly.

As well, whereas a specific geometry for the standard deck element is described with reference to FIG. 14, this specific geometry is not necessary and variance is contemplated for this deck element as follows:

| | | |
|---|---|---|
| A | thickness of panel | 105-126 |
| B | upper concrete cover | 55-82 |
| C | lower concrete cover | 34-55 |
| G | distance from centreline of hook bar to underside of stud cap | 18-29 |
| H | height of stud cap | 10 |
| I | height to stud cap | 70-90 |
| J | minimum coverage over Nelson stud | 24-35 |

As well, other deck elements can be utilized.

Figure 15:
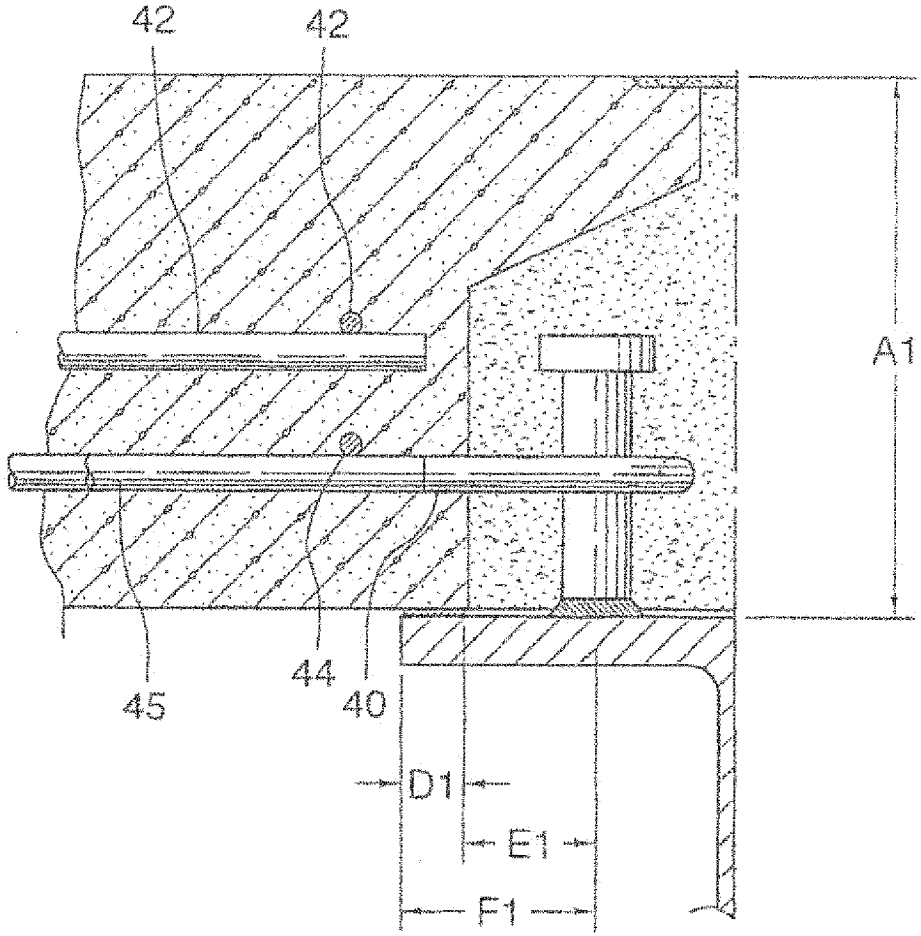
FIG. 15 is a view similar to FIG. 14, of another embodiment of the invention.

FIG. 15, for example, shows a more robust deck element, with two reinforcing lattices, the upper lattice having 8 mm wire 42 extending both transversely and longitudinally of the deck element and the lower lattice having 6mm wire 44 extending longitudinally of the deck element and 10 mm bar 45 extending transversely of the deck element. In this deck element, the various dimensions are as follows:

| | | |
|---|---|---|
| A1 | thickness of panel | 126-150 |
| B1 | upper concrete cover | 55- |
| C1 | lower concrete cover | 55- |
| D1 | minimum overlap of deck element on beam | 19 |
| E1 | distance of Nelson stud [centreline] from deck element | 36 |
| F1 | half-width of beam | 95 |
| G1 | distance from centreline of hook bar to underside of stud cap | 18-29 |
| H1 | height of stud cap | 10 |
| I1 | height to stud cap | 70-90 |
| J1 | minimum coverage over Nelson stud | 24-35 |

Figure 16:
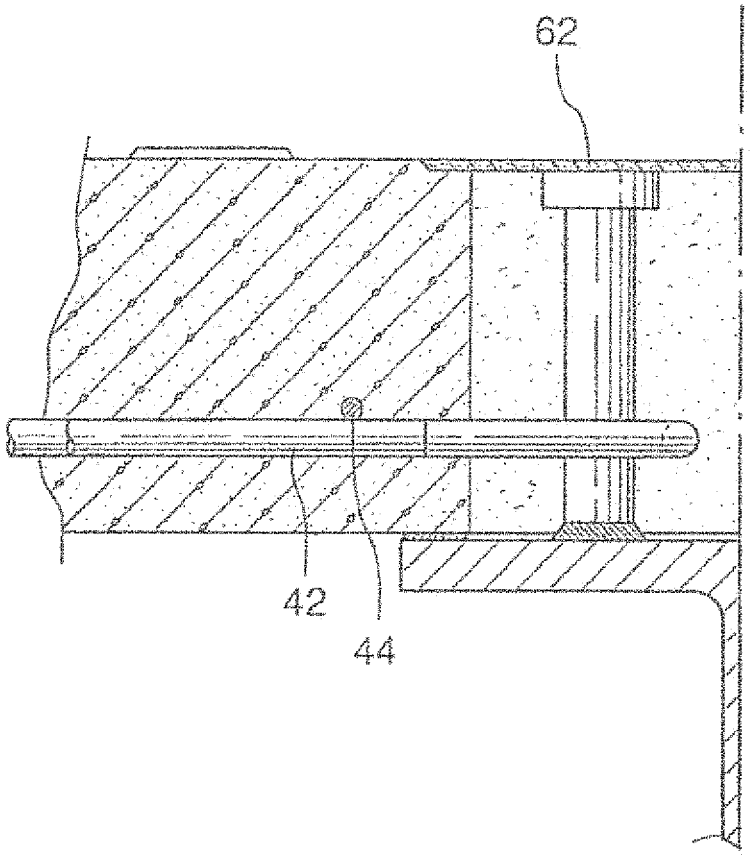
FIG. 16 is a view similar to FIG. 14, of another embodiment of the invention.

As well, FIG. 16, shows a relatively more lightweight deck element, with a single lattice having 6 mm wire 44 extending longitudinally of the deck element and 10 mm bar 45 extending transversely of the deck element. In this deck element, the various dimensions are as follows:

| | | |
|---|---|---|
| A2 | thickness of panel | 81 |
| B2 | upper concrete cover | 55 |

-continued

| | | |
|---|---|---|
| C2 | lower concrete cover | 10 |
| D2 | minimum overlap of deck element on beam | 19 |
| E2 | distance of Nelson stud [centreline] from deck element | 36 |
| F2 | half-width of beam | 95 |
| G2 | distance from centreline of hook bar to underside of stud cap | 53 |
| H2 | height of stud cap | 10 |
| I2 | height to stud cap | 70 |
| J2 | minimum coverage over Nelson stud | 3 |

Further, whereas in the exemplary embodiment, the parapet walls are constructed out of precast elements, and extend only to the piers, variations are possible. The precast elements could extend beyond the piers, in which case some of the loads to be carried by the bridge could be carried by the adjacent earth. As well, the parapet walls could be cast in situ, in which case, this could require the bridge to be built more robustly, to carry the load of the concrete associated with the parapet walls until cured. The parapet walls could also be constructed otherwise than from cementitious materials, or conceivably omitted altogether for some applications. Further, whereas the parapet walls are indicated to be cemented to the bridge, it should be understood that materials other than cement could be used to file the bores and lock the parapet walls in place.

Accordingly, the invention should be understood as limited only by the accompanying claims, purposively construed.

The invention claimed is:

1. A method of providing a parapet wall on a straight side edge of a deck, the method comprising the steps of:

providing a plurality of reinforcing members extending vertically from the deck at particular spaced intervals along the edge;

providing a precast cementitious element having defined therein a plurality of bores at said particular spaced intervals, said bored being generally tubular and extending from the bottom to the top of the precast element;

positioning the cementitious element on the deck with each bore in receipt of one of the reinforcing members; and cementing the bores, whereby the precast element, in use, reinforces the deck against sagging.

2. The method of claim 1 wherein the deck forms the roadbed of a bridge.

3. A method according to claim 1, wherein the plurality of bores are at least equal in number to the plurality of reinforcing members, such that each of the bores is in receipt of only a single reinforcement bar.

4. A method of providing a parapet wall for use with a deck having a plurality of reinforcing members extending perpendicularly therefrom at regular spaced intervals, the method comprising the steps of:

providing a precast cementitious element having opposed sides, and defined therein a plurality of generally tubular elongated bores extending from one side of the precast element through to the opposed side, the bores being at regular spaced intervals along the precast element, each of the bores having cross-sections of varying width along its length;

positioning the cementitious element on the deck with each bore in receipt of one of the reinforcing members; and cementing the bores, whereby the precast element, in use, defines a parapet wall in a bridge that also includes the deck, the wall reinforcing the deck against sagging.

5. A method according to claim 4, wherein the plurality of bores is at equal in number to the plurality of reinforcing members, such that each of the bores is in receipt of only a single reinforcement members.

* * * * *